US011466943B2

(12) United States Patent
Applegate

(10) Patent No.: US 11,466,943 B2
(45) Date of Patent: Oct. 11, 2022

(54) HIGH PERFORMANCE CERAMIC COOLING TOWER FILL SYSTEM AND RETAINERS

(71) Applicant: Rodney Applegate, Fort Worth, TX (US)

(72) Inventor: Rodney Applegate, Fort Worth, TX (US)

( * ) Notice: Subject to any disclaimer, the term of this patent is extended or adjusted under 35 U.S.C. 154(b) by 71 days.

(21) Appl. No.: 16/992,942

(22) Filed: Aug. 13, 2020

(65) Prior Publication Data

US 2021/0063101 A1 Mar. 4, 2021

Related U.S. Application Data

(60) Provisional application No. 62/885,937, filed on Aug. 13, 2019.

(51) Int. Cl.
*F28F 25/08* (2006.01)

(52) U.S. Cl.
CPC ..... *F28F 25/087* (2013.01)

(58) Field of Classification Search
CPC ..... F28F 25/087
USPC ..... 261/112.1, 112.2, DIG. 72
See application file for complete search history.

(56) References Cited

U.S. PATENT DOCUMENTS

| | | | | | |
|---|---|---|---|---|---|
| 2,042,127 | A * | 5/1936 | Sayles | F28F 25/087 | 261/DIG. 11 |
| 2,836,405 | A * | 5/1958 | Hamon | F28F 25/087 | 261/112.1 |
| 4,107,241 | A * | 8/1978 | Braun | B01D 3/22 | 428/116 |
| 4,202,847 | A * | 5/1980 | Ernst | F28C 1/02 | 261/DIG. 11 |
| 4,500,330 | A * | 2/1985 | Bradley, Jr. | B01D 45/08 | 55/440 |
| 4,774,033 | A * | 9/1988 | Raybon | F28B 1/06 | 261/109 |
| 6,517,058 | B1 * | 2/2003 | Engh | F28F 25/087 | 261/DIG. 11 |
| 7,278,631 | B1 * | 10/2007 | Pratt | F28F 25/082 | 261/DIG. 11 |
| 2020/0360935 | A1 * | 11/2020 | Lee | B03C 3/368 | |

* cited by examiner

*Primary Examiner* — Charles S Bushey
(74) *Attorney, Agent, or Firm* — Jackson Walker LLP

(57) ABSTRACT

High performance ceramic ("HPC") cooling tower fill plates with scalloped top and bottom edges and cross-hatched veins are used in combination with improved retainers in order to produce high performance, cooling tower fill bundles.

11 Claims, 9 Drawing Sheets

Notes: 1) All notes are in Millimeters

SIDE ELEVATION

HIGH PERFORMANCE CERAMIC COOLING TOWER FILL SYSTEM AND RETAINERS

This application is based upon and claims priority from U.S. Provisional application Ser. No. 62/885,937, which is incorporated herein by reference.

BACKGROUND OF THE INVENTION

Field of the Invention

High performance ceramic ("HPC") cooling tower fill combines the durability of high quality ceramic materials with innovative design features to produce a high performance, vertical flow heat transfer media for use in counterflow design water cooling towers.

Background Information

It is common to need to cool a building. This may be due to people or machines inside the building. The heat may be from external sources, such as the sun, or internal sources such as server rooms that generate heat within the building. Regardless of the source, heat may need to be reduced. It is common to lower heat within a building using a cooling tower. It is also possible to use a refrigeration system, referred to as an HVAC. This invention is for use with a cooling tower for use in cooling the building down.

The general functionality of a cooling tower is to circulate cool water from the cooling tower to the building, where it acts as a heat sink—heat from the building is reduced by it warming the cool water. The warm water is then circulated back to the cooling tower where it is cooled and the pumped to the building again in a constant cycle.

Cooling tower systems are widely used to provide cooling in industrial and commercial applications such as building HVAC, cold storage, and industrial cooling. Open recirculating cooling towers save a tremendous amount of energy and reduce greenhouse gas emissions compared to air cooled systems. The basic parts of such a cooling system are the cooling tower, a water pump, and a heat exchanger. There are one or more pipes that carry warm water from the building and connect with piping in the cooling tower, at or near the top of the cooling tower. Likewise, there are one or more pipes that carry cool water from piping in the cooling tower, at or near the bottom of the cooling tower, and connect to the building. So, the water being supplied to the building comes from the lower pipes. It is desirable to supply the building with cold water. Warm water will be returned to the cooling tower because it will pick up some of the heat out of the building to carry the heat away. Then the cooling tower will get rid of that heat and once the heat is removed the then cooled water can be sent back again to the building. The process will continue in order that heat can continually be removed from the building. Cooled water from the cooling tower is pumped through the heat exchanger in the building to be cooled and the cool water picks up heat. The now warm water is distributed over the top of a plurality of plates, the plurality of plates collectively called fill, in the tower. Relatively cool air moves past the warm water, cooling the water which is then recirculated through the building in a cycle. The basin water level drops due to these losses and more makeup water is added to maintain level.

SUMMARY OF THE INVENTION

HPC is a combination splash/film fill that is available with a standard wetted surface area of 35.3 $ft^2/ft^3$. It has a high specific surface area.

HPC is durable and is unaffected by the harsh environments encountered in cooling towers. Design and materials are ideally suited for operation with poor water quality and long-term exposure to high/low operating temperatures.

200° F.+ Hot Water does not cause a problem for HPC.

Dirty Water does not cause a problem for HPC.

Salt or Brackish Water does not cause a problem for HPC.

Freeze-ups do not cause a problem for HPC.

HPC performs where other fill media cannot.

Plate type vertical flow media has amassed a proven reputation as a low-fouling, high performance fill with a very long life. HPC introduces ceramic materials into this well-known vertical flow design to produce a low-fouling media with an expected service life of 50 years and more.

HPC performs similar to traditional cellular ceramic fill blocks; however, in a significantly reduced plan area and with less total fan horsepower to result in valuable real estate and energy savings. When compared to cross-corrugated PVC film fill, HPC produces similar performance without the thermal performance degradation that is normally associated with the high fouling rate and shorter useful operating life of PVC film fills.

Plate spacing for HPC can be readily varied for custom design configurations to address the dirtiest water applications.

HPC, in normal configuration, weighs about half that of traditional cellular ceramic block fill, which results in lower structure, basin and foundation costs.

Specification for Full Size Plates shown as one embodiment of the invention.

300 mm×600 mm×4 mm Unglazed Tiles

1. Absorption (COMPLETE)

Specification: Water absorption shall be less than 1%. Prefer <0.01%.

Test Method: SCW.ACF.02.02 (COMPLETE)

2. Dimensional Tolerances

Width Specification: The width dimension shall be 300+/−5 mm

Length Specification: The length dimension shall be 600+/−5 mm

Thickness Specification: The web thickness shall be 4.5 mm+/−0.15 mm, while the cell thickness shall be 3.0 mm+/−0.1 mm Test Method: SCWACF.01.02 (COMPLETE)

Warpage Specification: Plates will have a warpage tolerance of 1.5 mm

Test Method: SCWACF.03.02 (COMPLETE)

Modified version of Section 13 of ASTM C67

3. Weight: Full plates shall be weighed before measurement for dimensional tolerances. Weight Specification: Plates shall weigh less than 1.3 kilograms.

4. Physical Integrity Specification: The tile will be unglazed and fired to a fully vitrified body. Plates will be free of flaws that would cause mechanical failure in direction of service. Blemishes and discolorations are acceptable. Small pits, pocks and holes that do not extend more than ⅓ of the way into the thickness of the plate and are less than 2 mm wide are acceptable. Deformations or other inconsistencies that do not effect flatness, or mechanical integrity are acceptable. Portions missing (chips) are unacceptable. All inconsistencies that adversely affect the structural integrity of the plates are unacceptable.

5. Acid Solubility When Requested, Specification: Modified version of Section 8 of ASTM C301 preparation from ASTM C980. Product will be used in a water environment. Acid solubility will probably only need to be conducted on a yearly basis. Acid solubility testing may be necessary on a per job basis for unconventional applications. This will not be a responsibility of the manufacturer unless there is an ongoing problem with the materials.

6. Compressive Strength When Requested

Specification: The tile shall exhibit minimum compressive strength of 2000 pounds per square inch over the gross nominal area in the direction of use in an assembled state.

Test Method: Compressive Strength testing following Section 6 of ASTM C67. Testing will be done in the assembled state and simulate application conditions.

DETAILED DESCRIPTION OF THE PREFERRED EMBODIMENT

| Ref. | Element |
|---|---|
| 10 | cooling tower |
| 12 | upper pipe |
| 14 | top pipe |
| 16 | bottom pipe |
| 18 | lower pipe |
| 20 | pump |
| 22 | interior pipe |
| 24 | building pipe |
| 26 | heat exchanger |
| 28 | piping system |
| 30 | sprayer |
| 32 | fill |
| 34 | plate |
| 36 | fill bundle |
| 38 | plate face |
| 40 | plate top edge |
| 42 | plate bottom edge |
| 44 | plate side edge |
| 46 | fill bundle layer |
| 48 | vent |
| 50 | vein |
| 52 | port |
| 54 | drift eliminator |
| 56 | fan |
| 58 | reservoir |
| 60 | retainer |
| 62 | retainer first end |
| 64 | retainer first beta slot |
| 66 | retainer first arm |
| 68 | retainer first alpha slot |
| 70 | retainer first peak |
| 72 | retainer second arm |
| 74 | retainer second alpha slot |
| 76 | retainer second peak |
| 78 | retainer third arm |
| 80 | retainer second beta slot |
| 82 | retainer second end |

-continued

DETAILED DESCRIPTION OF THE PREFERRED EMBODIMENT

| Ref. | Element |
|---|---|
| 100 | building |
| 102a | water |
| 102b | warm water |
| 102c | cool water |

Figure 1:
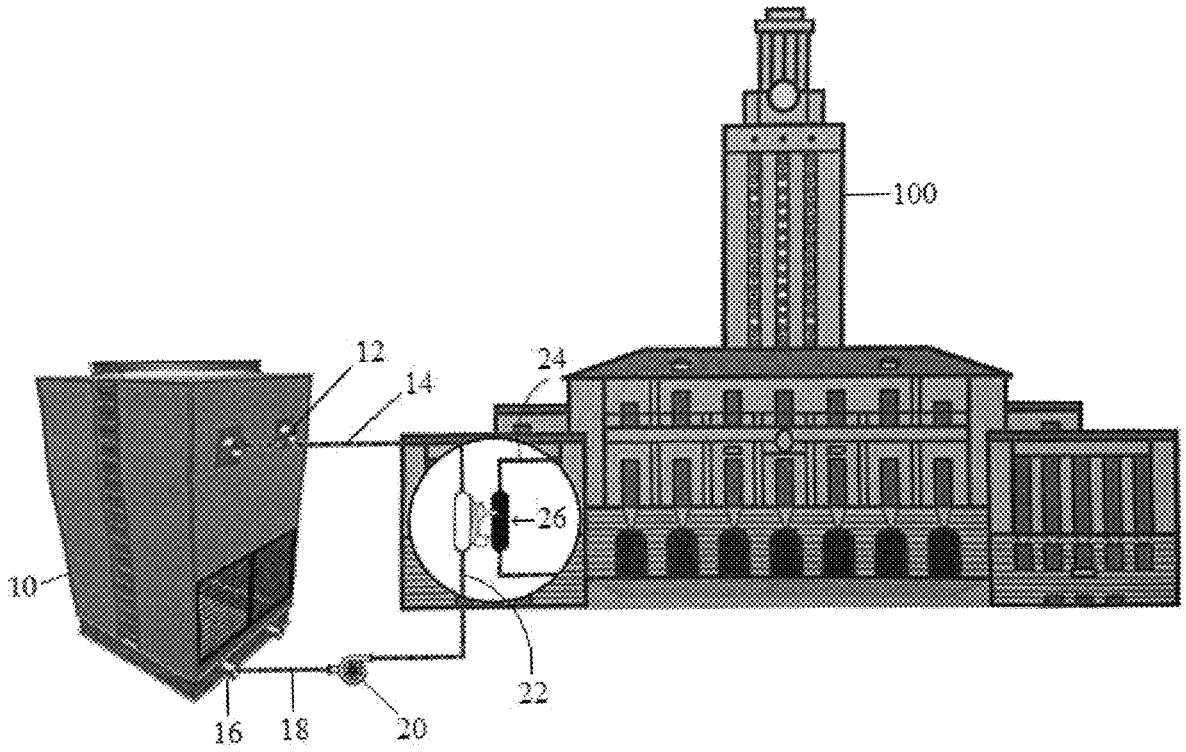
FIG. 1 is a schematic illustration of a cooling tower in operative communication with a heat exchanger inside a building.
Figure 2:
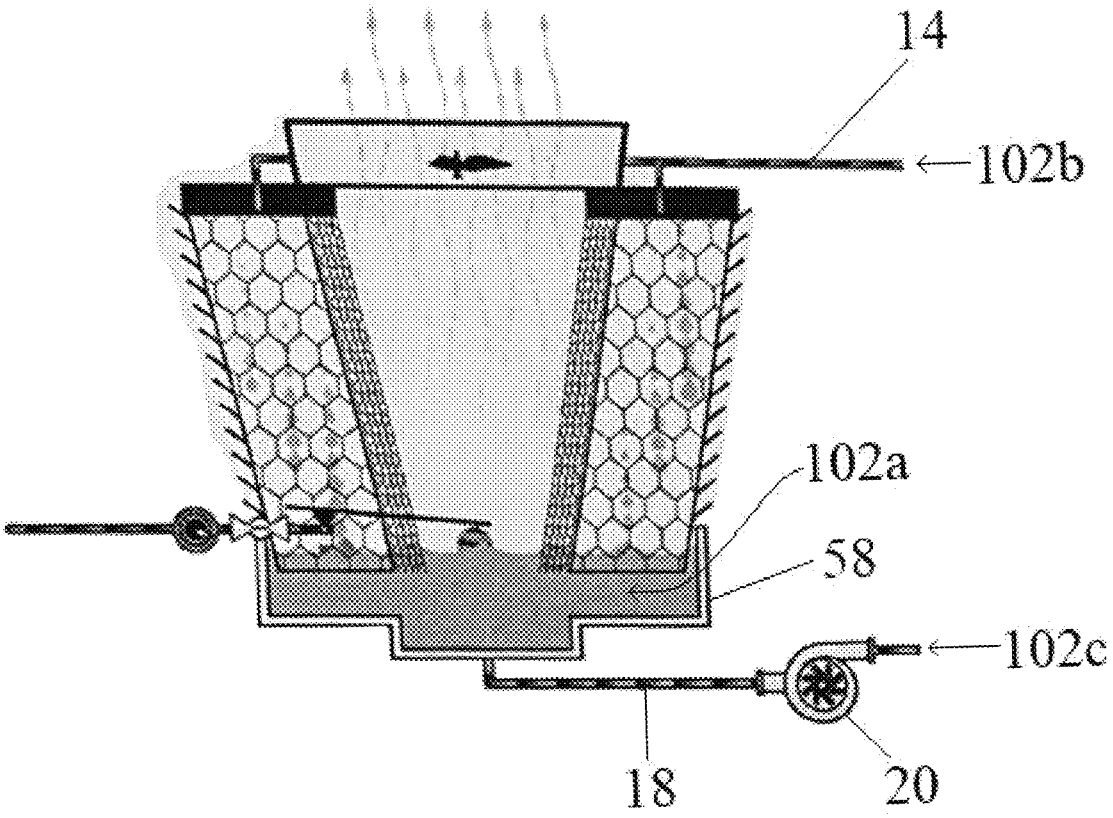
FIG. 2 is a side view of the interior of a cooling tower.
Figure 3:
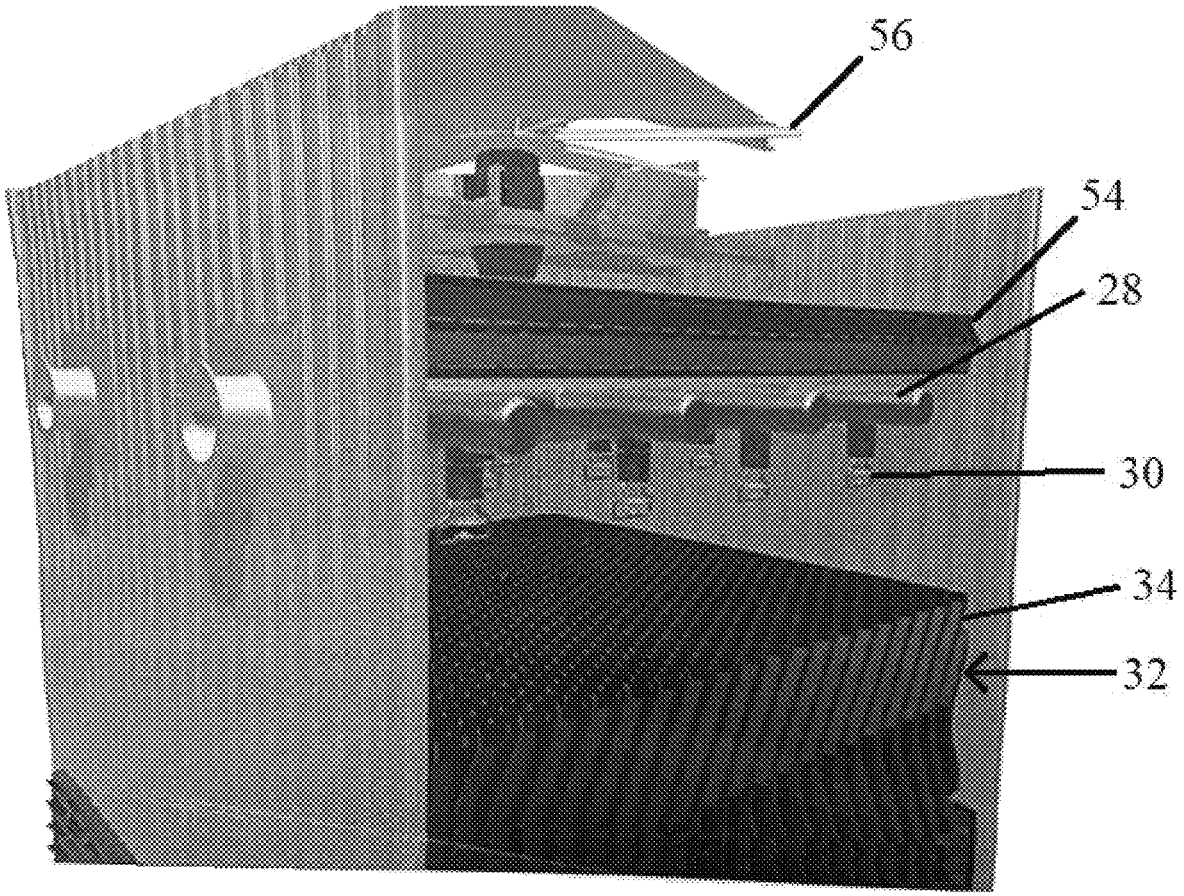
FIG. 3 is a cut-away perspective view of a cooling tower.

Referring to the figures, FIGS. 1, 2, and 3 illustrate the function of a cooling tower. FIG. 1 does not depict relative size. In order to function, warmed water 102*b* from the building 100 runs through top pipes 14 and into upper pipes 12 to enter into the top, or near the top, of the cooling tower 10. The cooled water 102*c* from the cooling tower 10 exits the cooling tower 10 at the bottom, or near the bottom, of the cooling tower 10 through the bottom pipes 16 and into lower pipes 18 into the building 100. One or more pumps 20 may be in operative communication with the top pipes 14, upper pipes 12, bottom pipes 16, or lower pipes 18 in order to cause, or help to cause, water to flow through the cooling system.

Thus, warmer water enters the cooling tower 10 through one or more upper pipes 12. The warmer water is distributed, or flows, through a piping system 28. The piping system 28 distributes the warm water about the upper area of the cooling tower 10. Sprayers 30 are in operative communication with the piping system 28. The warm water moves through the piping system 28 and is sprinkled out of the sprayers 30.

Below the piping system 28 and the sprayers 30 is the fill 32. The fill 32 is made up of a plurality of ceramic plates 34, and consists of a plurality of individual ceramic plates 34 which are arrayed in fill bundles 36 using retainers 60. Generally, a cooling tower 10 has multiple fill bundles 36 placed next to one another in a layer 46 of fill bundles 36. And, multiple layers 46 stacked on top of one another. The fill bundles 36 hold the faces 66 of the individual plates 34 generally vertically such that the water 102*a* dropping down hits the plates 34 on the plate top edge 40 or on the plate face 38 near the plate top edge 40, and runs down the face 38 to the plate bottom edge 42 is sprayed over the top layer 46, and the water 102*a* runs down the plate faces 38 of the bundles 36 and layers 46.

The plates 34 are generally rectangular, having a top edge 40, two (2) opposing side edges 44, and a bottom edge 42 opposite the top edge 40. The top 40, side 44, and bottom 42 edges bound two (2) faces 38. The edges (40, 42, and 44) may be linear but may also be curved, angled, or scalloped. Consequently, the faces 38 are generally planar, but may not be absolutely planar, and are not necessarily planar. Therefore, herein, reference to a face 38 being "planar" does not mean that the face 38 is absolutely flat, because while it can be flat, it may also be angled or curved.

In order to cool the warm water 102*b*, the warm water 102*b* sprays onto the fill 32 and plates 34. The water 102*a* on the fill plates 34 trickles down into the gaps between the plates 34. The water 102*a* drops form a film or thin layer of water 102*a* on the plate 34 and the water 102*a* tends to run down the faces 38. The plate 34 acts as a heat exchanger because the drops of water 102*a* forms a film of water 102*a* on the face 38. The area of the faces 38 is relatively large to the thickness of the film of water 102*a*. The cooling tower 10 actually has two ways of cooling. The first is that the water 102*b* sprays out of the sprayer 30 and lands on the plate 34 (which is effectively a heat exchanger), the air then comes in contact with the water 102*b* and takes the heat away. The second mechanism is that some of that water 102*b* will also evaporate and that also creates an additional cooling effect.

In order to get rid of the heat that the warm water 102*b* contains, air is drawn in from air outside of the cooling tower 10 through vents 48 generally near the bottom of the cooling tower 10. The air moves up through the layers 46 of fill 32 to the top or near the top of the cooling tower 10 where it exits the cooling tower 10 through ports 52.

Generally near the top of the cooling tower 10 is a fan 56, or fans 56. The fan 56 is positioned so as to pull air upward from the bottom of the cooling tower 10 and push the air out of the cooling tower 10 at or near the top. This type of cooling tower 10 is called an "induced mechanical draft cooling tower." If the fan 56 was installed at the bottom of the cooling tower 10 and pushed the air up through the fill 32, then it is called a "forced mechanical draft cooling tower." There are other types and mechanisms for cooling towers 10, but all work generally the same—air traveling across the wet plates 34 in order to cool the warm water 102*b*—even though they may have different embodiments.

Between the fill 32 and the ports 52 (in addition to the piping system 28 and sprayers 30), the cooling tower 10 may have drift eliminators 54. There is a loss of water 102*a* to the environment due to the evaporative cooling process. A drift eliminator 54 is designed to capture large water droplets caught in the cooling tower 10 air stream. The drift eliminator 54 helps prevent the water 102*a* droplets and mist from escaping the cooling tower 10.

Because of the shape of the plate face 38, the water 102*b* is spread out over a very large cross-sectional area. Thus, the warm water 102*b* is coming into contact with the air. The air is relatively cooler than the warm water 102*b*. The large face 38 area in contact with the thin film of warm water 102*b* causes a large heat transfer rate. The air takes away as much heat as possible in as short amount of time as possible, and the warm water 102*b* is cooled, becoming cool water 102*c*. Thus, as air exits the fill 32, it is warmer. Conversely, as the water 102*a* exits the bottom of the fill 32, it is cooler. The cool water 102*c* then drops off of the fill 32 and into a reservoir 58. The cool water 102*c* then can exit the cooling tower 10 through the bottom pipes 16 and on to the building 100 through the lower pipes 18. Water 102*c* flow may be helped by pumps 20. Once in the building 100, the cool water 102*c* flows through interior pipe 22 and through a heat exchanger 26 where the cool water 102*c* cools the air for distribution through in the building and the consequently warmed water 102*b* begins the process again.

Figure 4:
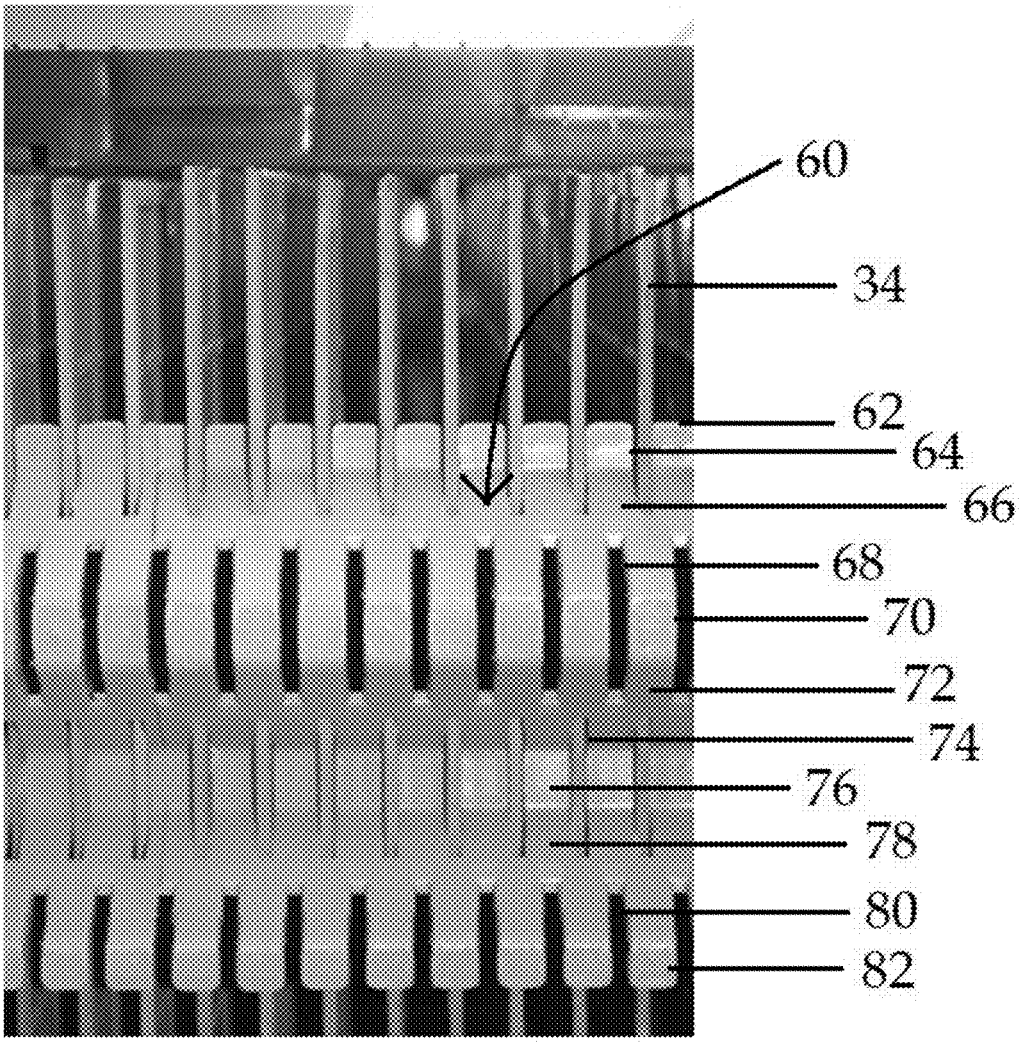
FIG. 4 is a side view of a portion of a fill bundle and retainer.

FIG. 4 shows side view of a portion of a fill bundle 36 and retainer 60. The fill bundle 36 is made up of a multiplicity of plates 34 which are held in place by a retainer 60. The retainers 60 hold the plates 34 upright and separated from each other. The retainer 60 may be generally described as "S" shaped. The upper, alpha portion of the retainer 34 is mirrored by the lower, beta portion of the retainer 34. The retainer 34 from top to bottom is comprised of a first end 62 connected to a first arm 66. The first arm 66 is angled outwardly between the first end 62 and a first peak 70. A second arm 72 angles inwardly from the first peak 72 to a second peak 76. A third arm 78 is angled inwardly between the second peak 76 and a second end 82. The first end 62 and the second end 82 face in opposite directions from each other. Likewise, the first peak 70 and the second peak 76 extend in opposite directions from each other.

There are four (4) sets of slots designed to retain the plates 34. The first beta slot 64 is an opening that extends between the retainer first end 62 and the first arm 66. Along the retainer 60, there are a multiplicity of first beta slots 64. The first alpha slot 68 is an opening that extends between the first arm 66, the first peak 70, and the second arm 72. Along the retainer 60, there are a multiplicity of first alpha slots 68. The second alpha slot 74 is an opening that extends between the second arm 72, the second peak 76, and the third arm 78. Along the retainer 60, there are a multiplicity of second alpha slots 74. The second beta slot 80 is an opening that extends between the third arm 78 and the second end 82. Along the retainer 60, there are a multiplicity of second beta slots 80.

The first beta slot 64 is in line with the second alpha slot 74, such that a plate 34-1 may be inserted into both the first beta slot 64 and the second alpha slot 74, and held generally upright. Likewise, the first alpha slot 68 is in line with the second beta slot 80, such that a plate 34-2 may be inserted into both the first alpha slot 68 and the second beta slot 80, and held generally upright. The first beta slot 64 and the second alpha slot 74 combination is offset from the first alpha slot 68 and the second beta slot 80 combination. This allows the retainer 60 to hold a first multiplicity of plates 34 on a first side and a second multiplicity of plates 34 opposite the first multiplicity of plates on a second side. Each of the slots 64, 68, 74, and 80, are sized in width to be just larger than the width of the plates 34 such that a plate 34-1 may be urged into the first beta slot 64 and the second alpha slot 74 combination and a plate 34-2 may be urged into the first alpha slot 68 and the second beta slot 80 combination. Because there are a multiplicity of these slot combinations along the length of the retainer 60, the retainer 60 can hold a multiplicity of plates 34 in an upright position on the retainer's 60 first and second sides.

Figure 5:
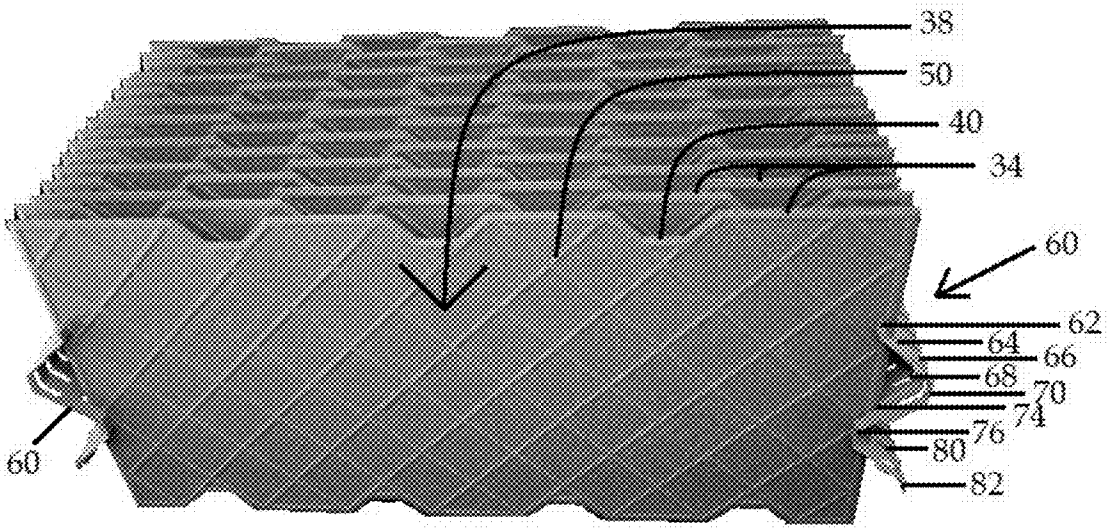
FIG. 5 is a perspective front view of a portion of a fill bundle and retainers.

FIG. 5 is a perspective front view of a portion of a fill bundle 36 and retainers 60. This figure illustrates a fill bundle 36 inserted into a first side of a retainer 60-1 and a second side of a retainer 60-2. The end of the retainer 60-1 shows the first end 62 extending over a side edge 44 of plate 34-1. Likewise, second peak 76 extends over side edge 44 of plate 34-1. Plate 34-1 is inserted and urged into first beta slot 64 and second alpha slot 74. Conversely, first peak 70, first alpha slot 68, second beta slot 80 and second end 82 extend away from plate 34-1.

The fill plates 34 are made of ceramic, or the HPC. The fill plate 34 has a top edge 40 opposite a bottom edge 42, end a first side edge 44-1 opposite a second side edge 44-2. The top edge 40, bottom edge 42, first side edge 44-1, and the second side edge 44-2 outline, or define, a first face 38-1 and an opposing, or backing, second face 38-2. The plates 34 feature scalloped top and bottom edges (40 and 42) which reduce flow restrictions between layers. The ribbed surface pattern of veins 50 on the faces (38-1 and 38-2) of the fill plate 34 may be cross-hatched and promotes uniform water distribution over the faces (38-1 and 38-2) of the fill plate 34. The veins 50 increase water dwell time and increases airflow turbulence. All of these attributes increase heat transfer between the air and the warm water 102*b* on the faces (38-1 and 38-2) of the fill plate 34. It is expected that the plates 34 will be made of HPC as described herein. The scalloped top and bottom edges (40 and 42) may be offset in adjoining plates 34.

Figure 6A:
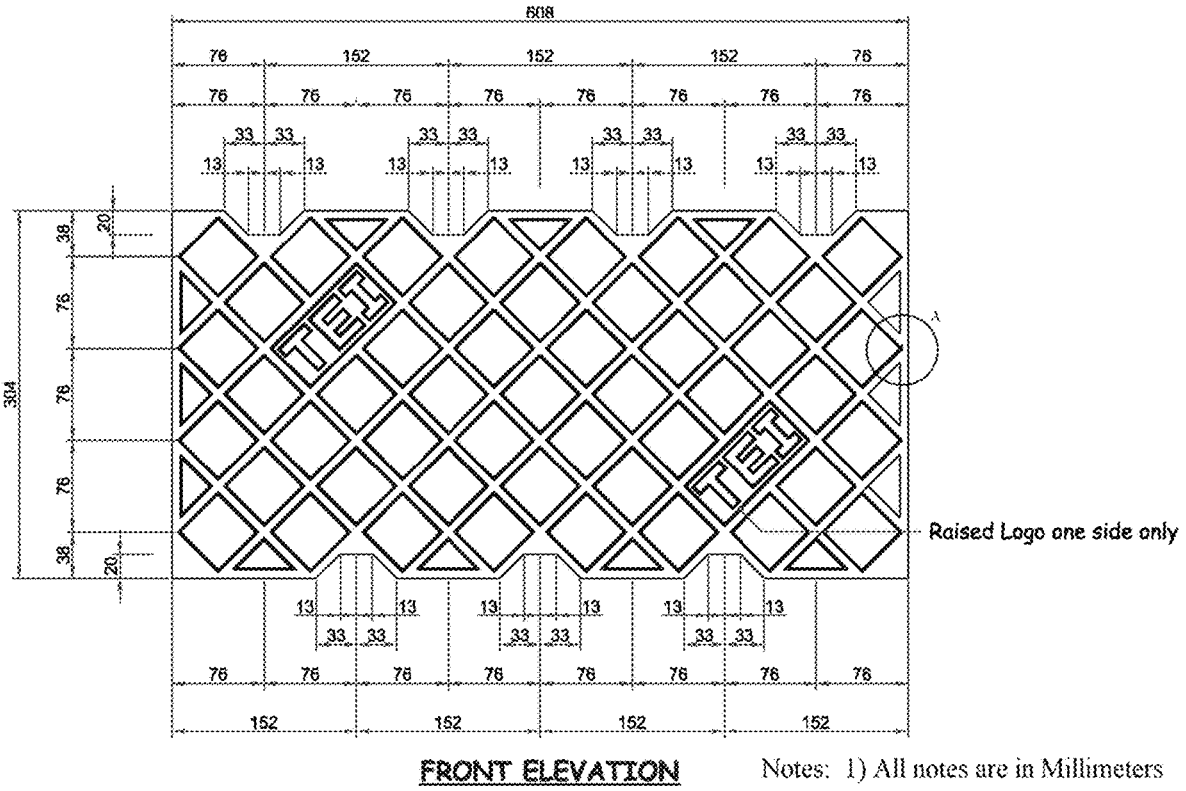
FIG. 6A is a diagram illustrating the front dimensions of an embodiment of a plate.
Figure 6B:
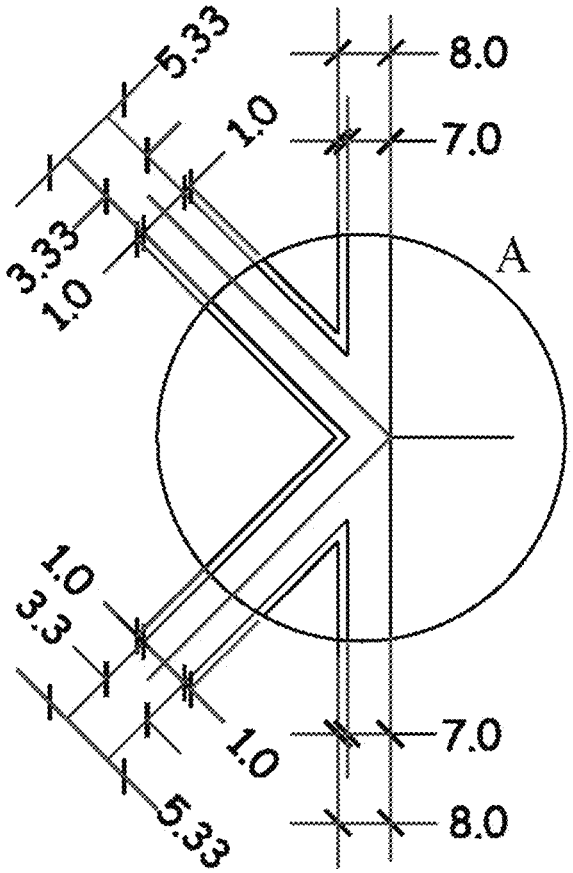
FIG. 6B is a diagram illustrating the blown up portion, section A, of the plate of FIG. 6A.
Figure 6C:
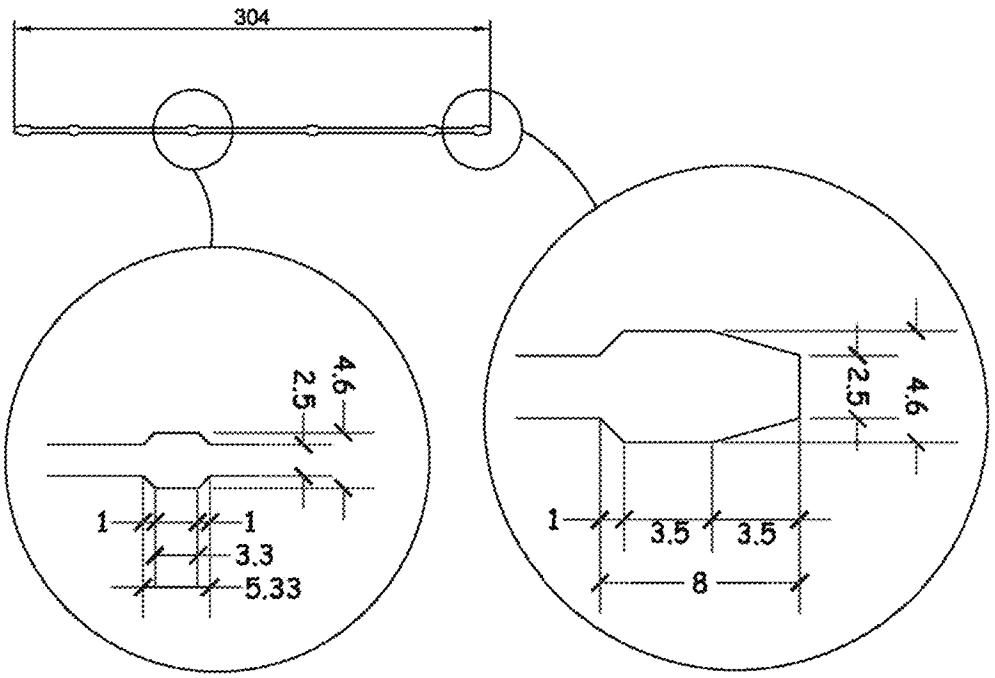
FIG. 6C is a diagram illustrating the side dimensions of the plate of FIG. 6A.

FIGS. 6A. 6B, and 6C are diagrams illustrating dimensions of an embodiment of a plate 34. It is anticipated that each of the dimensions may be plus or minus two (2) mm. It is also anticipated that larger or smaller plates 34 may be used that employ dimensions that are greater or larger, but scaled from the listed dimensions.

Figure 7:
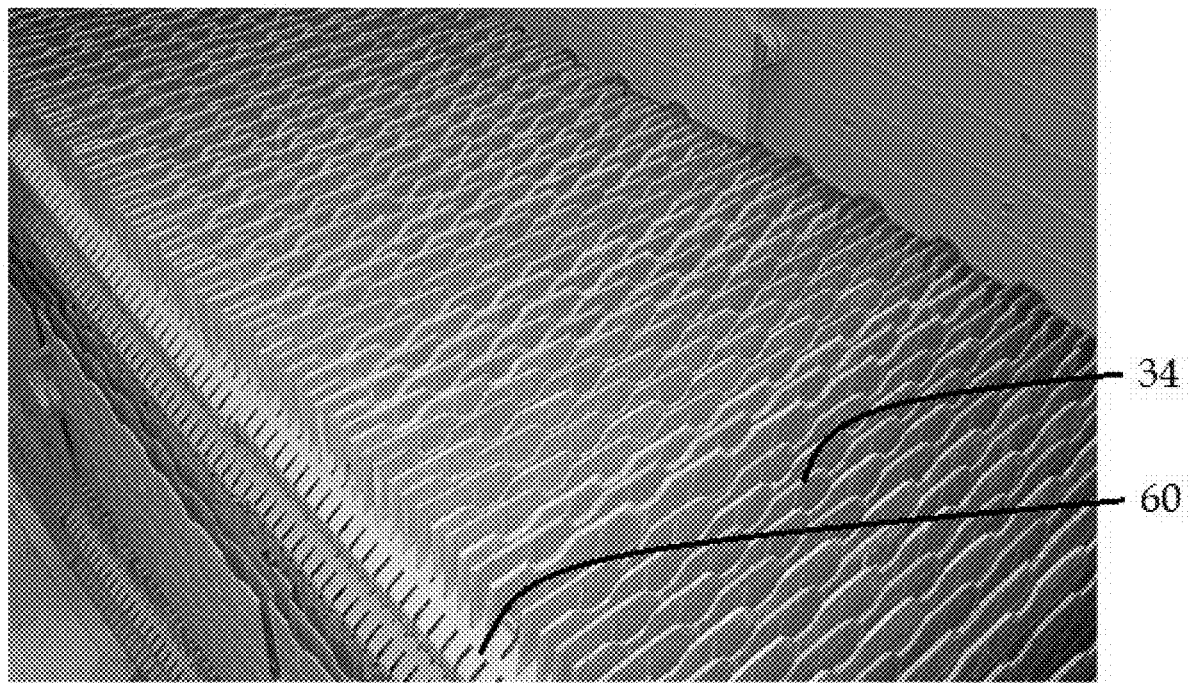
FIG. 7 is a perspective top view of a fill bundles and retainers.

FIG. 7 is a perspective top view of a fill bundles 36 with their plates 34 and retainers 60. The multiplicity of plates 34 and their top edges 40 are shown with retainer 60 urged on to the multiplicity of plate side edges 44. The scalloped top and bottom edges (40 and 42) are offset in adjoining plates (i.e. plates that are next to each other).

The retainers 60 allow for easier installation and repair of fill bundles 36. Conventional technology requires multiple copper tubes, with each copper tube "crimped" at each plate to provide the uniform plate 34 spacing. This spacing method is disadvantageous due to "racking and misalignment" of the plates over time. Further, the conventional technology requires that if a single plate needs to be replaced, the entire fill bundle 36 must be removed due to the continuous multiple crimped copper tubes that act as the uniform spacers for an entire assembled unit bundle. The retainer 60 eliminate the "racking and misalignment" possibilities, and very importantly allow for removal of single ceramic plates in a "fill bundle" without disturbing adjacent plates. Entire fill bundle replacement is eliminated. The retainer 60 design preserves the original plate 34 spacing to maintain the original thermal performance, if plate 34 removal is ever required over time. Thus, the overall plate bundle integrity for continued "original" thermal performance capability is preserved.

Additionally, the offset, scalloped plates 34 provide for an "egg crate" installation. Above and below the fill bundle 36, the top edges 40 and bottom edges 42 are a part of the thermal design and act as an "air and water balancing plate" at the top and bottom of the fill bundle 36. Additionally, the "egg crate" thermal design provides protection from maintenance foot traffic on the top surface of the fill 32.

Unless otherwise specifically noted, articles depicted in the drawings are not necessarily drawn to scale, however the drawings do depict relative size and placement.

Throughout this disclosure, a hyphenated form of a reference numeral refers to a specific instance of an element and the un-hyphenated form of the reference numeral refers to the element generically or collectively. Thus for example, widget 12-1 would refer to a specific widget of a widget class 12, while the class of widgets may be referred to collectively as widgets 12 and any one of which may be referred to generically as a widget 12.

It should be noted that when "about" or "approximately" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities and the like used in the present specification and associated claims are to be understood as being modified in all instances by the terms "about" or "approximately." As used herein, the terms "about" or "approximately" encompasses +/−5% of each numerical value. For example, if the numerical value is "about 80%," then it can be 80%+/−5%, equivalent to 75% to 85%. Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

The terms "about" or "approximately" are defined as being close to as understood by one of ordinary skill in the art, and in one non-limiting embodiment the terms are defined to be within 10%, preferably within 5%, more preferably within 1%, and most preferably within 0.5%.

The term "substantially" and its variations are defined as being largely but not necessarily wholly what is specified as understood by one of ordinary skill in the art, and in one non-limiting embodiment substantially refers to ranges within 10%, within 5%, within 1%, or within 0.5%.

The terms "inhibiting" or "reducing" or any variation of these terms refer to any measurable decrease, or complete inhibition, of a desired result. The terms "promote" or "increase" or any variation of these terms includes any measurable increase, or completion, of a desired result.

The term "effective," as that term is used in the specification and/or claims, means adequate to accomplish a desired, expected, or intended result.

The terms "a" or "an" when used in conjunction with the term "comprising" in the claims and/or the specification may mean "one," but it is also consistent with the meaning of "one or more," "at least one," and "one or more than one."

The term "each" refers to each member of a set, or each member of a subset of a set.

The terms "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

In interpreting the claims appended hereto, it is not intended that any of the appended claims or claim elements invoke 35 U.S.C. 112(f) unless the words "means for" or "step for" are explicitly used in the particular claim.

It should be understood that, although exemplary embodiments are illustrated in the figures and description, the principles of the present disclosure may be implemented using any number of techniques, whether currently known or not. The present disclosure should in no way be limited to the exemplary implementations and techniques illustrated in the drawings and description herein. Thus, although the invention has been described with reference to specific embodiments, this description is not meant to be construed in a limited sense. Various embodiments may include some, none, or all of the enumerated advantages. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention. Modifications, additions, or omissions may be made to the systems, apparatuses, and methods described herein without departing from the scope of the disclosure. For example, the operations of the systems and apparatuses disclosed herein may be performed by more, fewer, or other components in the methods described may include more, fewer, or other steps. Additionally, steps may be performed in any suitable order.

I claim:

1. Fill bundles for use in cooling towers comprising:

a fill plate, wherein said fill plate is made of ceramic;

wherein said fill plate has a top edge opposite a bottom edge, and a first side edge opposite a second side edge, and said top edge, bottom edge, first side edge, and said second side edge define a first face and an opposing second face;

wherein said top edge is scalloped;

a crosshatch of veins on said first face and said second face;

a retainer, wherein said retainer is generally "S" shaped and has a width, and wherein said retainer comprises a first end connected to a first arm wherein said first arm is angled outwardly between said first end and a first peak; a second arm angled inwardly from said first peak to a second peak; a third arm angled outwardly between said second peak and a second end; wherein said first end and said second end extend in opposite directions from each other, and said first peak and said second peak extend in opposite directions from each other;

wherein said retainer further comprises a first beta slot that extends between said retainer first end and said first arm; a second alpha slot that extends between said second arm, said second peak, and said third arm;

wherein said first beta slot and said second alpha slot are sized in width to be just larger than a width of said plate, and said first beta slot and said second alpha slot are in line with each other creating a first beta slot and second alpha slot combination, such that said plate side edge may be urged into said first beta slot and said second alpha slot;

said fill plate urged into said first beta slot and second alpha slot combination; and wherein said fill plate is held generally upright.

2. The apparatus of claim 1, further comprising:

a multiplicity of said fill plates;

a multiplicity of said first beta slot and second alpha slot combinations; and wherein one (1) of each of said multiplicity of said fill plates is held by one (1) of each of said multiplicity of said first beta slot and said second alpha slot combinations.

3. The apparatus of claim 2, wherein scalloped top and bottom edges (40 and 42) are offset in adjoining plates.

4. The apparatus of claim 1, further comprising:

a first alpha slot that extends between said first arm, said first peak, and said second arm;

a second beta slot that extends between said third arm and said second end;

wherein said first alpha slot and said second beta slot are sized in width to be just larger than said width of said plate, and said second beta slot and said first alpha slot are in line with each other creating a second beta slot and first alpha slot combination, such that said plate side edge may be urged into said second beta slot and said first alpha slot;

wherein said first beta slot and second alpha slot combination is offset from said second beta slot and first alpha slot combination;

said fill plate urged into said second beta slot and first alpha slot combination; and wherein said fill plate is held generally upright.

5. The apparatus of claim 4, further comprising:

a multiplicity of said fill plates;

a multiplicity of said first beta slot and second alpha slot combinations;

a multiplicity of said second beta slot and first alpha slot combinations; and wherein one (1) of each of said multiplicity of said fill plates is held by one (1) of each of said multiplicity of said first beta slot and said second alpha slot combinations and said multiplicity of said second beta slot and first alpha slot combinations.

6. The apparatus of claim 5, wherein scalloped top and bottom edges (40 and 42) are offset in adjoining plates.

7. A retainer capable of holding fill plates, comprising:

a first end connected to a first arm wherein said first arm is angled outwardly between said first end and a first peak;

a second arm angled inwardly from said first peak to a second peak;

a third arm angled outwardly between said second peak and a second end;

wherein said retainer is generally "S" shaped and has a width;

wherein said first end and said second end extend in opposite directions from each other, and said first peak and said second peak extend in opposite directions from each other;

a first beta slot that extends between said retainer first end and said first arm;

a second alpha slot that extends between said second arm, said second peak, and said third arm;

wherein said first beta slot and said second alpha slot are sized in width to be just larger than a width of said plate, and said first beta slot and said second alpha slot are in line with each other creating a first beta slot and second alpha slot combination, such that said plate side edge may be urged into said first beta slot and said second alpha slot;

a first alpha slot that extends between said first arm, said first peak, and said second arm;

a second beta slot that extends between said third arm and said second end;

wherein said first alpha slot and said second beta slot are sized in width to be just larger than said width of said plate, and said second beta slot and said first alpha slot are in line with each other creating a second beta slot and first alpha slot combination, such that said plate side edge may be urged into said second beta slot and said first alpha slot; and wherein said first beta slot and second alpha slot combination is offset from said second beta slot and first alpha slot combination.

8. Fill bundles for use in cooling towers comprising:

a fill plate;

a retainer, wherein said retainer is generally "S" shaped and has a width, and wherein said retainer comprises a first end connected to a first arm wherein said first arm is angled outwardly between said first end and a first peak; a second arm angled inwardly from said first peak to a second peak; a third arm angled outwardly between said second peak and a second end; wherein said first end and said second end extend in opposite directions from each other, and said first peak and said second peak extend in opposite directions from each other;

wherein said retainer further comprises a first beta slot that extends between said retainer first end and said first arm; a second alpha slot that extends between said second arm, said second peak, and said third arm;

wherein said first beta slot and said second alpha slot are sized in width to be just larger than a width of said plate, and said first beta slot and said second alpha slot are in line with each other creating a first beta slot and second alpha slot combination, such that said plate side edge may be urged into said first beta slot and said second alpha slot;

said fill plate urged into said first beta slot and second alpha slot combination; and wherein said fill plate is held generally upright.

9. The apparatus of claim 8, further comprising:

a multiplicity of said fill plates;

a multiplicity of said first beta slot and second alpha slot combinations; and wherein one (1) of each of said multiplicity of said fill plates is held by one (1) of each of said multiplicity of said first beta slot and said second alpha slot combinations.

10. The apparatus of claim 8, further comprising:

a first alpha slot that extends between said first arm, said first peak, and said second arm;

a second beta slot that extends between said third arm and said second end;

wherein said first alpha slot and said second beta slot are sized in width to be just larger than said width of said plate, and said second beta slot and said first alpha slot are in line with each other creating a second beta slot and first alpha slot combination, such that said plate side edge may be urged into said second beta slot and said first alpha slot;

wherein said first beta slot and second alpha slot combination is offset from said second beta slot and first alpha slot combination;

said fill plate urged into said second beta slot and first alpha slot combination; and wherein said fill plate is held generally upright.

11. The apparatus of claim 10, further comprising:

a multiplicity of said fill plates;

a multiplicity of said first beta slot and second alpha slot combinations;

a multiplicity of said second beta slot and first alpha slot combinations; and wherein one (1) of each of said multiplicity of said fill plates is held by one (1) of each of said multiplicity of said first beta slot and said second alpha slot combinations and said multiplicity of said second beta slot and first alpha slot combinations.

* * * * *